United States Patent [19]

Fujiwara

[11] Patent Number: 4,563,959

[45] Date of Patent: Jan. 14, 1986

[54] STEP TYPE STOKER WITH OSCILLATION MECHANISM

[75] Inventor: Koji Fujiwara, Osaka, Japan

[73] Assignee: Kabushiki Kaisha Takuma, Osaka, Japan

[21] Appl. No.: 673,706

[22] Filed: Nov. 21, 1984

[30] Foreign Application Priority Data

Jan. 9, 1984 [JP] Japan ..... 59-2463

[51] Int. Cl.[4] ..... F23H 7/08; F23H 7/14

[52] U.S. Cl. ..... 110/281; 110/278; 110/291; 110/299; 110/328; 414/156

[58] Field of Search ..... 110/281, 282, 283, 284, 110/278, 291, 109, 328, 298, 299; 414/156; 198/300, 750

[56] References Cited

U.S. PATENT DOCUMENTS

| | | | |
|---|---|---|---|
| 794,575 | 7/1905 | Wilkinson | 110/281 |
| 1,563,762 | 12/1925 | Lundgren | 110/282 |
| 1,760,256 | 5/1930 | Riley | 110/300 X |
| 4,510,873 | 4/1985 | Shigaki | 110/282 X |

*Primary Examiner*—Edward G. Favors
*Attorney, Agent, or Firm*—Griffin, Branigan & Butler

[57] ABSTRACT

The present invention relates to a step type stoker with an oscillation mechanism having: a plurality of stoker frames (2 and 2') which are installed at an interval in the upstream to downstream direction, and at least one of which forms an air supply path (5); reciprocating fire grates (3) each of which is formed with a plurality of fire grate members (8) installed in a step-like manner on a groove-shaped frame (7) equipped with an air path (6) which is in communication with the aforementioned air supply path (5) at all times; and fixed fire grates (4) each of which is formed with a plurality of fire grate members 8 installed in a step-like manner in a groove-shaped frame (7) equipped with an air path (6) which is in communication with the aforementioned air supply path (5) at all times. The fixed fire grates are arranged to be adjacent to and parallel with the aforementioned movable fire grates (3), but are fixed on the aforementioned stoker frames (2 and 2').

5 Claims, 15 Drawing Figures

STEP TYPE STOKER WITH OSCILLATION MECHANISM

The present invention is concerned with a step type stoker with an oscillation mechanism for use with an incinerator to burn city refuse.

As illustrated in FIGS. 9–15, a prior-art conventional step type stoker 30 with an oscillation mechanism comprises movable fire grates 31 and fixed fire grates 32 installed alternately and in parallel.

The aforementioned movable fire grates 31 and fixed fire grates 32, both of which possess similar structure, are each formed with a plurality of fire grate members 34 arranged in a step-like manner on the upper surface of an elongated groove-shaped frame 33 which is equipped with a hole for air conduction formed on its bottom wall.

As illustrated in FIG. 13, the aforementioned fire grate members 34 are arranged on the groove-shaped frame 33 and comprise fire-grate frames 35 which are positioned on opposite sides and a plurality of grate plates 36 between the two fire grate frames 35.

As illustrated in FIG. 11, under the groove-shaped frame 33 of the aforementioned movable fire grate 31, there are attached sliding boxes 38, each with a sliding plate 37 attached thereto, located at an upstream position and at a downstream position of the groove-shaped frame 33.

Each sliding box 38 rides on a shoe 40 affixed on the upper part of a stoker frame 39, and the movable fire grate 31, comprising the sliding boxes 38, the groove-shaped frame 33 and the fire grate members 34 performs a sliding movement back and forth at the sliding plate 37 and the shoe 40.

On the other hand, as illustrated in FIG. 12, under the groove-shaped frame 33 of the aforementioned fixed fire grate 32 there are also provided fixed boxes 41 at two places, one at the upstream position and the other at the downstream position of the groove-shaped frame 33, but here there is no sliding between the boxes 41 and the stoker frames 39.

As illustrated in FIG. 9, the aforementioned movable fire grates 31 are arranged in parallel to reciprocate back and forth a fixed distance by means of a driving mechanism 42 comprising a fluid pressure cylinder, a driving shaft, a driving level, a push lever, a push rod, etc., by sliding on the stoker frames 39, thus pushing the burning materials A sitting on the step type stoker 30 toward the downstream end.

However, fixed on the stoker frame 39, the fixed fire grate 32 does not reciprocate back and forth.

The air required for combusting the aforementioned burning materials (city refuse) A is conducted through a duct 43 into a hopper 44 installed at the lower part of the step-type stoker 30, and then is supplied through the step-type stoker 30 into the burning materials A.

As illustrated in FIGS. 14 and 15, there is provided a gap $G_1$ between the movable fire grates 31 and the fixed fire grates 32.

Furthermore, as illustrated in FIG. 13, for each of the fire grate members 34 there are provided gaps $G_2$ and $G_3$ respectively between the fire grate frames 35 and grate plates 36 and between the grate plates 36 respectively.

Thus, the air requird for combustion is led into the burning materials A through the aforementioned gaps $G_1$, $G_2$ and $G_3$.

However, the aforementioned conventional step type stoker 30 is so structured that the duct 43 is installed on the side of the hopper 44, and the air for combustion is first conducted into the large hopper 44 and then fed into the burning materials A through the gaps $G_1$, $G_2$ and $G_3$ of the step type stoker 30, thus resulting in uneven flow of the air for combustion—with more air flow in some parts and less in others—in the hopper.

Therefore, the air required for combustion is found uneven when it is injected through the aforementioned gaps $G_1$, $G_2$ and $G_3$ of the step type stoker 30 into the burning materials A, thus making difficult complete and uniform combustion of the burning materials A.

This uneven combustion becomes more apparent when the area of the step type stoker 30 is larger. For this reason, a solution to this problem for larger types of city refuse incinerators has been desired.

Recently, it has been found that with a city refuse incinerator the burning temperature of the burning materials A becomes very high because city refuse today possesses high calorific value.

Therefore, aluminum cans or materials such as plastics, which have a low melting temperature and which are found in great quantity in burning materials A these days, are easily melted in the furnace. As a result, the gaps $G_1$, $G_2$ and $G_3$ are clogged with melted materials which hang down through the aforementioned gaps $G_1$, $G_2$, and $G_3$ of the step type stoker 30, thus resulting in even more uneven flow of air for combustion.

SUMMARY OF THE INVENTION

The present invention is intended to solve the aforementioned problems related to oscillating step type stokers.

It is a first object of the present invention to provide a step type stoker with an oscillation mechanism which feeds combustion air evenly into the burning materials A regardless of the size of a fire plate, thus resulting in complete and uniform combustion of the burning materials A.

It is a second object of the present invention to provide a step type stoker with an oscillation mechanism with which air flow into the burning materials A is not affected by melted materials even when aluminum cans, plastics and the like melt, thus allowing a uniform air supply into the burning materials A.

A feature of the present invention for accomplishing the aforementioned objectives is that it is so structured that air for combustion is compelled to be evenly injected into the burning materials A and further melted materials are promptly discharged. Thus, even when these materials are melted, adhesion and accumulation of the melted materials inside the fire grates are prevented.

That is, a step type stoker with an oscillation mechanism of this invention comprises a plurality of stoker frames 2' and 2 which are installed at a fixed distance in an upstream to downstream direction, and at least one of which (frame 2') forms an air supply path 5.

Movable fire grates 3, each of which is formed of a plurality of fire grate members 8 installed in a step-like manner on a groove-shaped frame 7, have air paths 6 which are always in communication with the air supply path 5 even when they reciprocate back and forth on the aforementioned stoker frames 2' and 2. Fixed fire grates 4, each of which is formed of a plurality of fire grate members 8 installed in a step-like manner on a groove-shaped frame 7, have air paths 6 which are also in communication with the aforementioned air supply path 5 at all times. The groove-shaped frames 7 of the movable and fixed fire grates are arranged to be adjacent and parallel to each other with the movable fire grates 3 being slidable on the stoker frames 2' and 2 but the fixed fire grates being fixed on the frames 2' and 2.

The air for combustion is sent pressurized from the air supply path 5 formed in the stoker frame 2' to inside each fire grate member 8 through the air paths 6 formed in each of the groove-shaped frames 7, and is injected into the burning materials A through upper openings 20, i.e. gaps between a fire grate frame 16 and a fire plate 17.

Air for combustion which is led from inside the fire grate members 8 to outside through gaps (lower openings 21) provided along the side walls of the fire grate frame 16 hits a bottom cover (not illustrated) and turns to be injected into the burning materials A through gaps between the movable fire grates 3 and the fixed fire grates 4.

Furthermore, melted materials left on the stoker move down a concave part of the upper surface of the fire plate 17, and are promptly discharged out. Even when melted materials find their way from the upper openings 20 into the fire grate 8, they are discharged through the lower openings 21.

Since the present invention is constructed as mentioned above, these excellent effects are apparent:

(1) Flow paths for combustion air are formed independently for each of the movable and fixed fire grates 3 and 4 and the air for combustion is so conducted that it is evenly injected into the burning materials A, thus ensuring complete and uniform combustion. With a stoker which possesses a large grate area, the effect is more apparent.

(2) Even when some of the melted materials flow into the grate members through the upper openings 20, it is discharged promptly from the lower openings 21 through a discharge chamber 19 so that the melted materials do not find their way into the fire grates 8, particularly into the pressure chamber 18 and the inner opening of the groove-shaped frame 7. Hence these materials do not adhere to, harden and/or accumulate therein when cooled. This ensures the uninterrupted, stable flow at all times of air for combustion.

(3) Each fire grate member 8 is equipped with a discharge chamber 19 with the lower openings 21 at the bottom thereof. The lower openings 21 are situated outside of a shoe 11, thus preventing adhesion and accumulation of the melted materials on the shoe 11. Therefore, the smooth reciprocating movement of the movable fire grates is ensured.

(4) The air for combustion flows at high pressure and at high speed along the inner and outer surfaces of each fire grate member 8. Therefore, the flow of the air further improves the cooling effect, thus preventing damage to the fire grates caused by burning.

(5) The fire plate 17 of each fire grate 8 is employed as a single unit. Because of this, its assembling and/or replacement can be performed with ease.

DETAILED DESCRIPTION OF THE INVENTION

Figure 1:
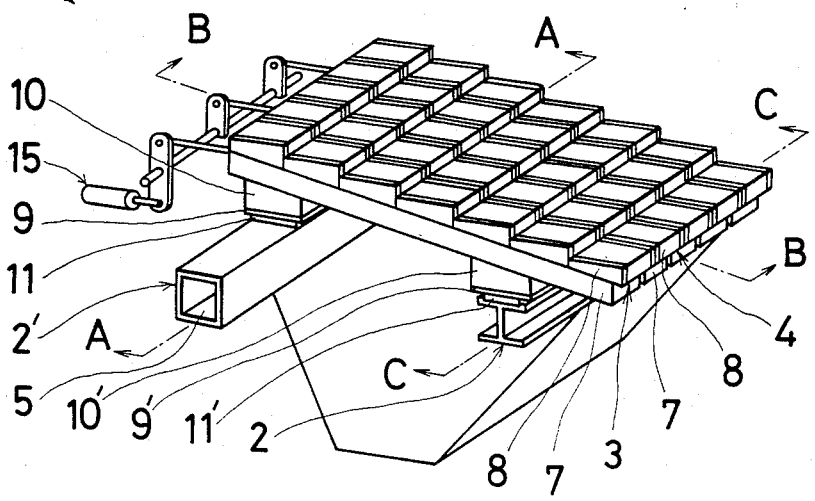
FIG. 1 is a perspective illustration of a step type stoker with an oscillation mechanism according to one of the embodiments of the present invention.
Figure 2:
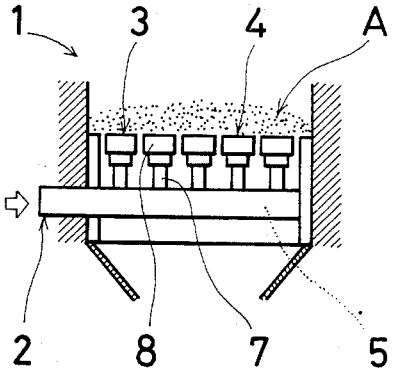
FIG. 2 is a front view, partially in schematic, of a step type stoker of this invention with an oscillation mechanism.

The present invention is described in detail with reference to the embodiment illustrated in FIGS. 1–8.

The main part of the step type stoker 1 with an oscillation mechanism of the present invention comprises stoker frames 2' and 2, a plurality of movable fire grates 3 which are so installed that they can slide back and forth a fixed distance on the stoker frames 2' and 2 and a plurality of fixed fire grates 4 fixed on the stoker frames 2' and 2. The aforementioned movable fire grates 3 and fixed fire grates 4 are arranged alternately and in parallel to each other.

The aforementioned stoker frames 2' and 2 are installed in parallel at a fixed separation interval. The upstream stoker frame 2' and downstream stoker frame 2 are formed with a square pipe and an H-shaped steel beam respectively. The inside of the upper stoker frame 2' functions as a tubular air supply path or passage 5. With this embodiment, the air supply path 5 is only provided at the upper stoker frame 2', however, the lower stoker frame 2 can also be made of a square pipe so that it also has an air path.

Figure 3:
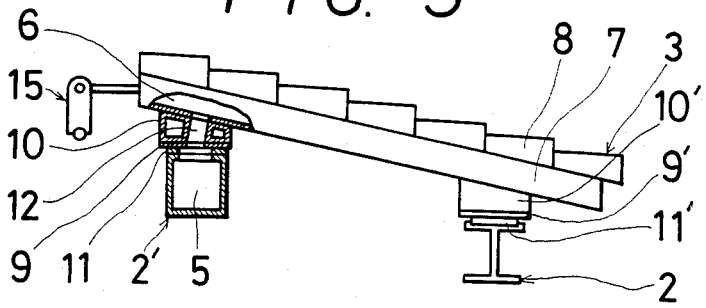
FIG. 3 is a side view of a movable fire grate of the stoker of FIG. 1.

As illustrated in FIG. 3, the movable fire grate 3 in the present invention is formed by arranging a plurality of fire grate members 8 in a step-like manner on a groove-shaped frame 7 with an air path 6 inside the groove-shaped frame 7.

The groove-shaped frame 7 is so constructed that it can reciprocate back and forth, by the provision of a sliding box 10 positioned between the groove-shaped frame 7 and the stoker frame 2' and a sliding box 10' positioned between the groove-shaped frame 7 and the stoker frame 2. That is, the sliding boxes 10 and 10' are attached under their respective groove-shaped frames 7 of the movable fire grates 3 and, in turn, slide on the stoker frames 2' and 2. In this respect, under the bottom surface of the sliding boxes 10 and 10' are sliding plates 9 and 9'. The sliding plates 9 and 9' are resting on shoes 11 and 11' fitted on the upper surfaces of the respective stoker frames 2' and 2. The movable fire grates 3 slide backward and forward, with the sliding plates 9 and 9' sliding on the shoes 11 and 11'.

Figure 6:
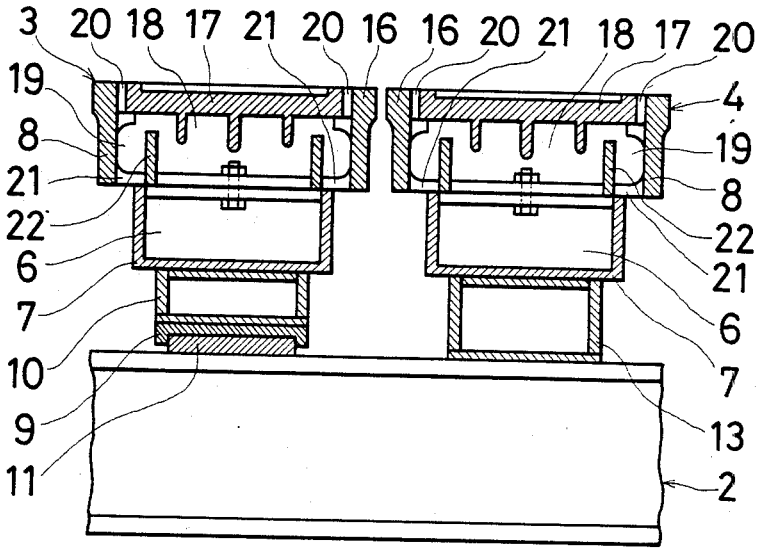
FIG. 6 is an enlarged sectional view taken on the line C—C of FIG. 1.

Shakes of the aforementioned sliding plates 9 and 9' and the shoes 11 and 11' in the left and right directions are prevented since they are constructed to be engaged and fitted together as shown in FIG. 6. At the same time, dust and similar substances are not able to find their way between the sliding surfaces due to this construction.

With regard to the upstream stoker frame 2', shoe 11, sliding plate 9, sliding box 10 and the groove-shaped frame 7, there is formed an enclosed communicating passage or path 12 running through the sliding box 10 which links the air supply path 6 in the groove-shaped frame 7, thus allowing communication of the air supply path 5 with the air path 6 at all times regardless of the reciprocating movement of the movable fire grate 3.

Figure 4:
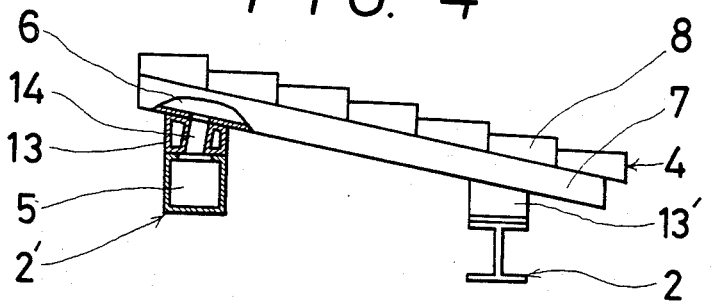
FIG. 4 is a side view of a fixed fire grate of the stoker of FIG. 1.

As illustrated in FIG. 4, a fixed fire grate 4 in the present invention is formed by arranging a plurality of fire grate members 8 in a step-like manner on the groove-shaped frame 7 with an air path 6 inside. The aforementioned groove-shaped frame 7 is fixed on the upstream and downstream stoker frames 2' and 2 with the fixed boxes 13 and 13' being positioned therebetween.

Namely, the fixed boxes 13 and 13' are fixed under the groove-shaped frame 7 of the fixed fire grate 4 and further are fixed on the stoker frames 2' and 2.

With regard to the upstream stoker frame 2', the fixed box 13 and groove-shaped frame 7, there is formed a communicating path 14 running through the fixed box 13 which links the air supply path 5 in the stoker frame 2' with the air path 6 in the groove-shaped frame 7 at all times (FIG. 4).

As illustrated in FIG. 1, the aforementioned movable fire grates 3 and fixed fire grates 4 are installed alternately and arranged in parallel. Each movable fire grate 3 is driven backward and forward on the stoker frames 2' and 2 by means of a driving mechanism 15 which comprises a fluid pressure cylinder, a driving shaft, a driving level, a push lever and a push rod.

Figure 5:
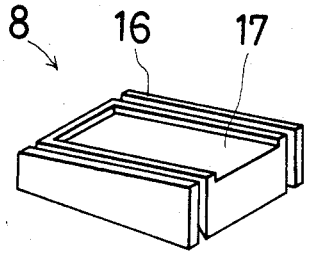
FIG. 5 is a perspective illustration of a fire grate member which constitutes a movable fire grate and a fixed fire grate of this invention.

As illustrated in FIGS. 5 and 6, each fire grate member 8 which constitutes a part of both the movable fire grate 3 and the fixed fire grate 4 comprises a fire grate frame 16 and a fire plate 17 which is fitted in an upper open section of the fire grate frame 16. The same fire grate member 8 is used on both the movable fire grate 3 and the fixed fire grate 4.

Figure 7:
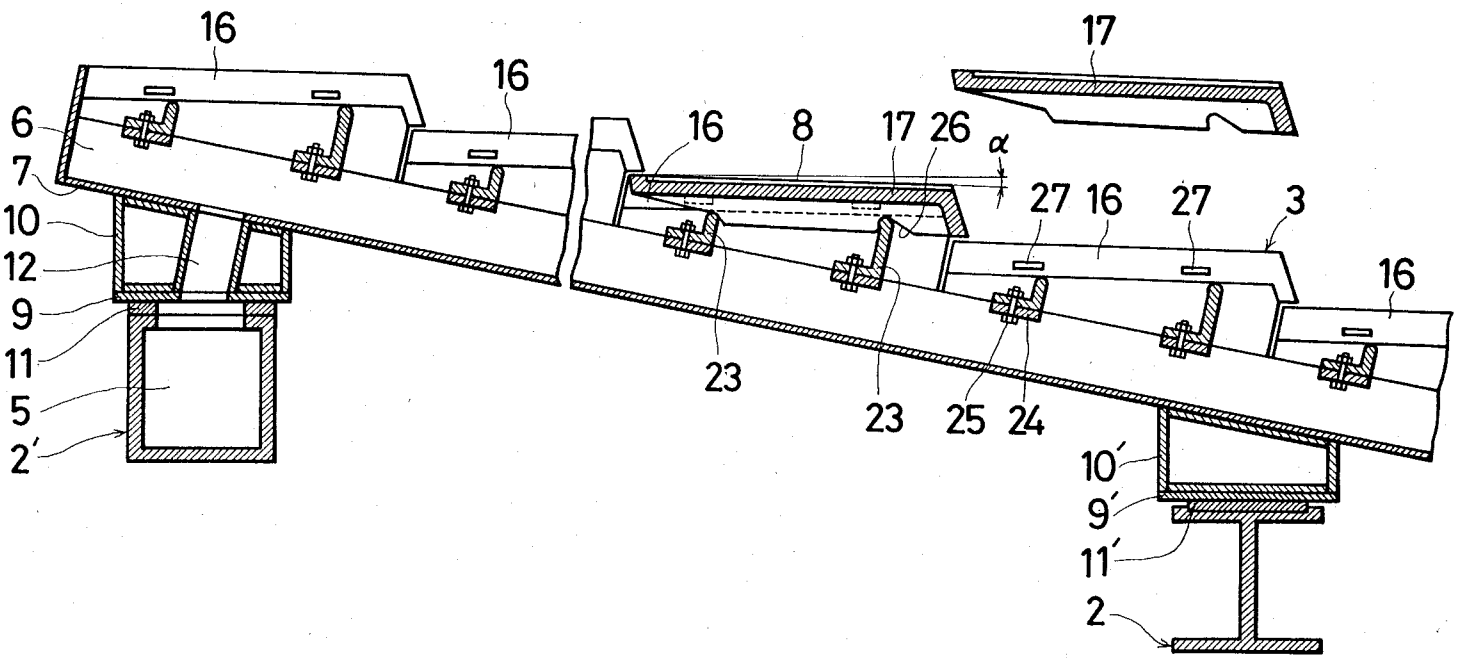
FIG. 7 is an enlarged sectional view taken on the line B—B of FIG. 1.

The fire grate frame 16 of the fire grate member 8 comprises side plates positioned on the left and right, and upstream and downstream L-shaped ribs 23 which link these side plates (FIG. 7). As illustrated in FIG. 7, the fire grate frames 16 are fixed on the upper surface of the groove-shaped frame 7 by bolts 25, base plates 24 being fitted on the groove-shaped frame 7 and the aforementioned ribs 23.

The fire plate 17 of the fire grate member 8 is fixed on the fire grate frame 16 by engaging the top of the upstream and downstream ribs 23 of the fire grate frame 16 in upstream and downstream recesses 26 provided on the fire plate 17.

Furthermore, projections 27 are provided on the inner surface of the side plates of the fire grate frame 16. Shakes of the fire plat 17 to the left and right are prevented by contact of the outer surface of the fire plate 17 with the projections 27.

Figure 8:
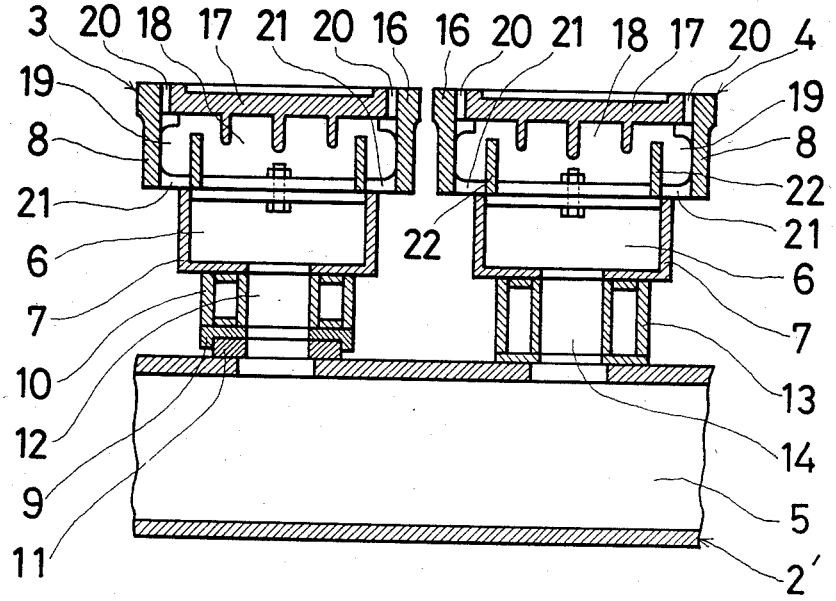
FIG. 8 is an enlarged sectional view taken on the line A—A of FIG. 1.
Figure 9:
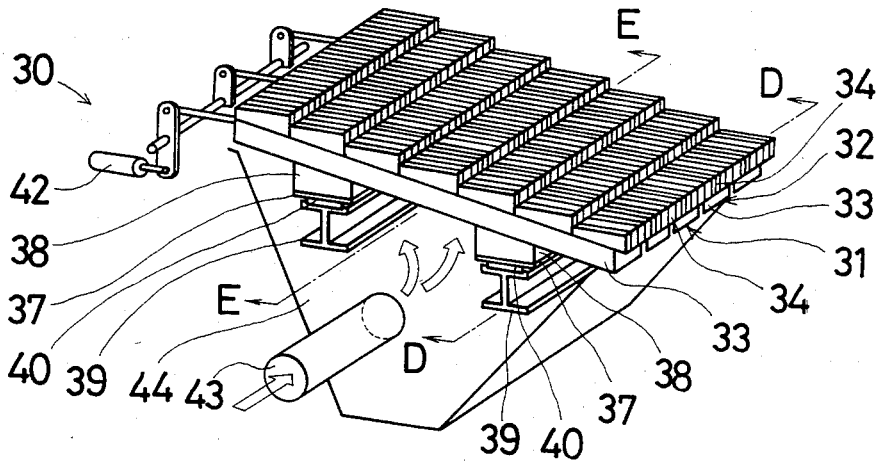
FIG. 9 is a perspective illustration of a conventional step type stoker with an oscillation mechanism.
Figure 10:
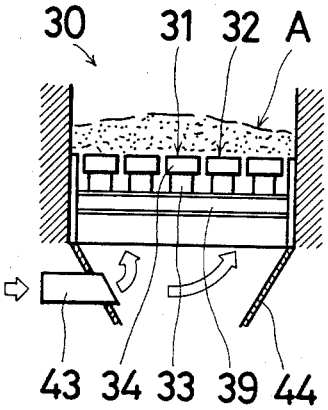
FIG. 10 is a front view of a conventional step type stoker with an oscillation mechanism.
Figure 13:
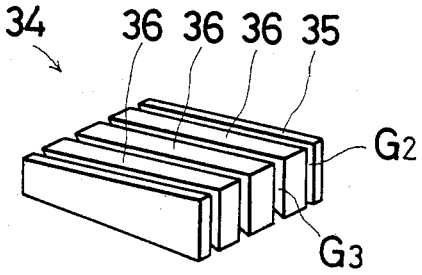
FIG. 13 is a perspective illustration of a fire grate member which constitutes a conventional movable fire grate and a fixed fire grate.
Figure 11:
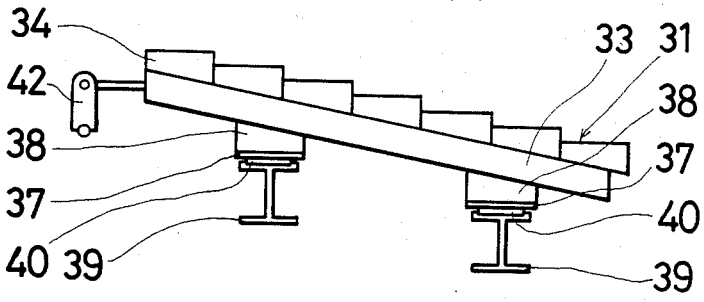
FIG. 11 is a side view of a movable fire grate which constitutes a conventional step type stoker.
Figure 12:
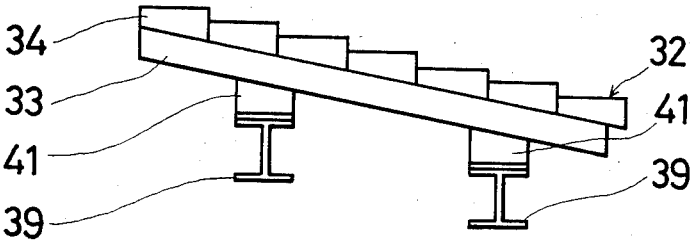
FIG. 12 is a side view of a fixed fire grate which constitutes a conventional step type stoker.
Figure 14:
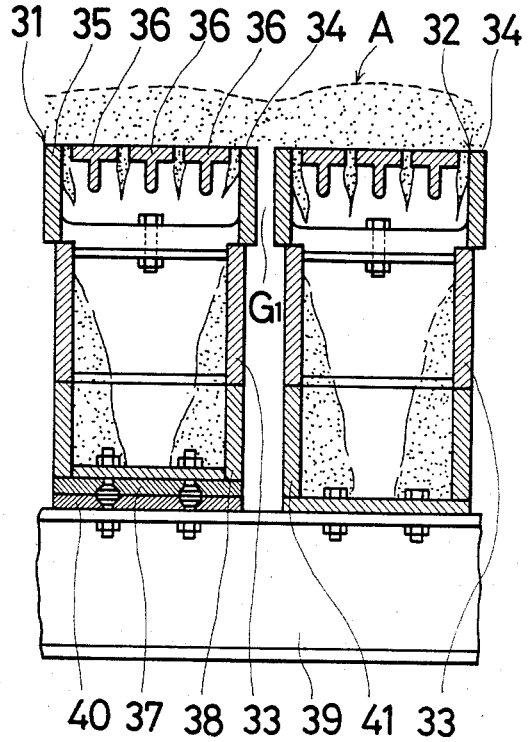
FIG. 14 is an enlarged sectional view taken on the line D—D of FIG. 9; and, FIG. 15 is an enlarged sectional view taken on the line E—E of FIG. 9.
Figure 15:
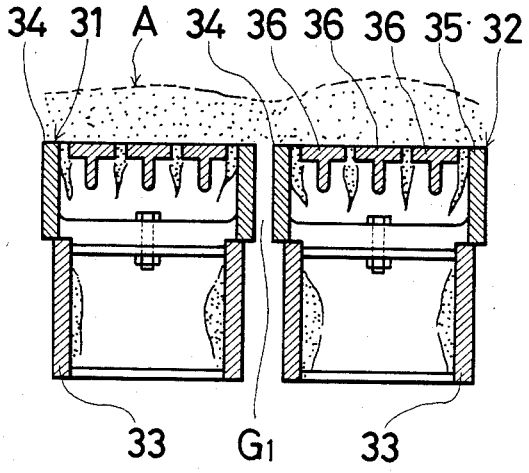

As illustrated in FIG. 8, in the center of the inside of the aforementioned fire grate member 8, there is formed a pressure chamber 18 which is in communication with the air path 6 in the groove-shaped frame 7. On both sides of the aforementioned pressure chamber 18 there are formed discharge chambers 19 which are in communication with the pressure chamber 18 with a partition wall 22 being provided therebetween In addition, at the upper and lower parts of the aforementioned discharge chambers 19, there are formed an upper opening 20 and a lower opening 21 respectively, which keep the discharge chamber 19 in communication with the outside of the fire grate 8.

Both the upper opening 20 and the lower opening 21 are shaped like a slit. The lower opening 21 is situated exactly beneath the upper opening 20, and is larger in width than the upper opening 20.

To improve air cooling effects, the fire plate 17 is provided with a suitable number of the projected fins on its lower surface which faces the pressure chamber 18.

The upper surface of the fire plate 17 has a concave shape by forming projected parts at both sides. At the same time, it is so designed that the upper surface of the fire plate 17 forms a slope which gradually descends from the upstream end to the downstream end at an angle $\alpha$ relative to a horizontal plane.

Operation of the present invention will now be explained.

By operating the driving mechanism 15, each movable fire grate 3 reciprocates back and forth on the upper and lower stoker frames 2' and 2 for a fixed distance, thus allowing burning materials A fed from the upstream end to move gradually to the downstream end.

The air for combustion is led into the pressure chamber 18 of each fire grate member 8 from the air supply path 5 in the stoker frame 2' through a communicating path 12 in the movable fire grates 3 and a communicating path 14 in the fixed fire grate 4 as well as through the air path 6 in a groove-shaped frame 7. The air is sent pressurized into the layers of the burning materials A at high pressure and at high speed from the upper openings 20 through the discharge chambers 19 on both sides.

A part of the air for combustion fed into the discharge chamber 19 is ejected from the lower opening 21 toward outside the fire grate, but is turned and directed into the layers of the burning materials A through a gap which is formed between the movable fire grate 3 and the fixed fire grates 4 (FIG. 6).

Even when the burning materials A contain a large amount of aluminum cans or materials such as plastics with a low melting temperature, it is so designed that the upper surface of the fire plate 17 of the fire grate 8 is of concave shape, and forms a slope which gradually descends from the upstream end to the downstream end, thus allowing the melted materials to move quickly down the surface of the fire plate toward the downstream end.

If some of the melted materials flow into the discharge chamber 19 through the opening 20, they are promptly discharged from the lower opening 21 through the discharge chamber 19.

While the invention has been particulary shown and described with reference to a preferred embodiment, it will be understood by those skilled in the art that various changes in form and detail may be made therein without departing from the spirit and scope of the invention.

The embodiments of the invention in which an exclusive right or privilege is claimed are defined as follows:

1. A step type stoker with an oscillating mechanism comprising:

a plurality of stoker frames which are installed at fixed intervals in an upstream to downstream direction, and at least one of which is tubularly-shaped to form an air supply path;

movable fire grates each of which is formed of a plurality of fire-grate members installed in a step-like manner on a groove-shaped frame, said groove-shaped frame being equipped with an air path which is in communication with the air supply path in the aforementioned tubularly-shaped stoker frame at all times, said groove-shaped frame being supported by, but reciprocating on, the aforementioned stoker frames; and fixed fire grates each of which is formed with a plurality of fire grate members installed in a step-like manner on a groove-shaped frame equipped with an air path which is in communication with the air supply path in the aforementioned stoker frame at all times, each said fixed fire grate being arranged to be adjacent to and parallel with the aforementioned movable fire grate, and being fixed on each of the aforementioned stoker frames;

wherein is further included at least one sliding box which is fixed to the underside of the groove-shaped frame of a movable grate which rides on an upper surface of a turbularly-shaped stoker frame, the air supply path in the stoker frame and the air supply path in the groove-shaped frame being in communication by means of a communicating path passing through said at least one sliding box.

2. A step type stoker with an oscillation mechanism as claimed in claim 1 wherein the stoker frame which forms an air supply path is formed of a square pipe.

3. A step type stoker with an oscillation mechanism as claimed in claim 1 wherein at least one fixed box is fixed to the underside of the groove-shaped frame of a fixed fire gate and rests on an upper surface of said at least one stoker frame and the air supply path in said at least one stoker frame and the air path in the groove-shaped frame being in communication by means of a communicating path passing through said at least one fixed box.

4. A step type stoker with an oscillation mechanism as claimed in claim 1 wherein said fire-grate members of both the movable fire grates and the fixed fire grates are each formed of a channel-shaped fire grate frame and a fire plate which is fitted in an upper open section of the channel-shaped fire grate frame; each of the fire-grate members defining on the inside thereof a pressure chamber which is in communication with the air path in the aforementioned groove-shaped frame, and discharge chambers which are situated on the both sides of the aforementioned pressure chamber; and at upper and lower portions of aforementioned discharge chambers, are respectively formed an upper opening and lower opening respectively, both of which communicates with outside of the fire-grate member.

5. A step type stoker with an oscillation mechanism as claimed in claim 4 wherein the upper surface of the fire plate has a concave shape and forms a slope which gradually descends toward the downstream end.

* * * * *